US010925444B2

(12) United States Patent
Harounian

(10) Patent No.: US 10,925,444 B2
(45) Date of Patent: Feb. 23, 2021

(54) ROLL HOLDER

(71) Applicant: Kaveh Harounian, Beverly Hills, CA (US)

(72) Inventor: Kaveh Harounian, Beverly Hills, CA (US)

( * ) Notice: Subject to any disclaimer, the term of this patent is extended or adjusted under 35 U.S.C. 154(b) by 0 days.

(21) Appl. No.: 16/037,220

(22) Filed: Jul. 17, 2018

(65) Prior Publication Data

US 2018/0338648 A1 Nov. 29, 2018

Related U.S. Application Data

(63) Continuation-in-part of application No. 14/994,978, filed on Jan. 13, 2016, now Pat. No. 10,028,626.

(51) Int. Cl.

| | |
|---|---|
| ***A47K 10/22*** | (2006.01) |
| ***A47K 10/38*** | (2006.01) |
| ***A47K 10/32*** | (2006.01) |

(52) U.S. Cl.

CPC ..... *A47K 10/22* (2013.01); *A47K 10/38* (2013.01); *A47K 2010/3233* (2013.01); *A47K 2201/02* (2013.01)

(58) Field of Classification Search

CPC ..... A47K 10/22; A47K 10/38; A47K 2010/3233; B65H 16/06

USPC ..... 242/404, 404.3, 406, 588, 598, 598.5

See application file for complete search history.

(56) References Cited

U.S. PATENT DOCUMENTS

| | | | | |
|---|---|---|---|---|
| 833,238 | A * | 10/1906 | Pitschke | B65H 23/06 242/422.4 |
| 6,162,534 | A * | 12/2000 | Hamerski | C09J 7/22 428/354 |
| 6,305,035 | B1 | 10/2001 | Morris | |
| 7,172,152 | B2 | 2/2007 | Wardell | |
| D833,168 | S * | 11/2018 | Hussain | B65H 75/185 D6/518 |
| 2015/0014472 | A1* | 1/2015 | Hussain | B65H 75/185 242/598 |

FOREIGN PATENT DOCUMENTS

| | | | |
|---|---|---|---|
| CN | 1357029 | A | 7/2002 |
| CN | 1704315 | A | 12/2005 |
| JP | 3-157132 | | 7/1999 |
| KR | 10-2000-0012265 | A | 3/2000 |
| KR | 20-2010-0005174 | | 3/2000 |
| WO | WO 2001/056446 | A1 | 8/2001 |

OTHER PUBLICATIONS

Moddea, "Diabolo Toilet Roll Holder", [online], Apr. 29, 2013 [retrieved on Feb. 27, 2017]. Retrieved from the Internet: https://moddea.com/2013/04/29/diablo-toilet-roll-holder.

(Continued)

*Primary Examiner* — William E Dondero

(74) *Attorney, Agent, or Firm* — Brooks Kushman P.C.

(57) ABSTRACT

A holder for a roll of toilet paper or a roll of absorbent sheet material, the holder including cordage inserted through the hollow core of the paper roll, the cordage being secured in various embodiments to one or more patches or suction cups mountable to a surface. A roller in the form of a tube can be provided through which the cordage is inserted and which itself is inserted through the paper role core.

3 Claims, 16 Drawing Sheets

(56) References Cited

OTHER PUBLICATIONS

PCT Search Report and Written Opinion dated May 15, 2017 in connection with PCT/US2017/013339.
European supplementary search report dated Aug. 20, 2019 in connection with European Patent Appl. No. 17739002.8.
Chinese Office Action dated May 25, 2020 in connection with related Chinese Patent Appl. No. 2017800067874.
Chinese Office Action dated Oct. 16, 2020 in connection with related Chinese Patent Application No. 2017800067874.

* cited by examiner

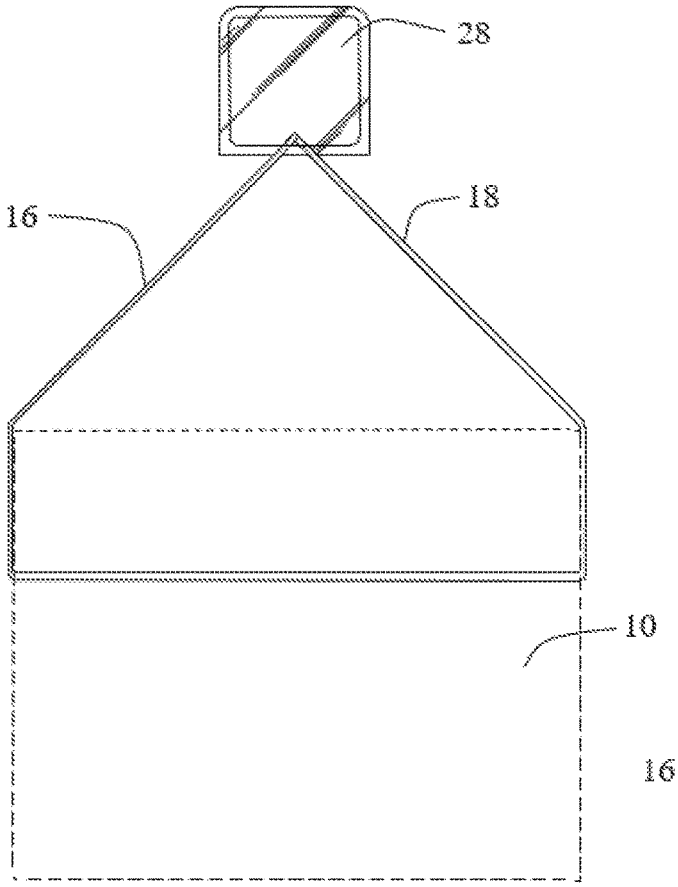
Fig. 3A
Fig. 3B
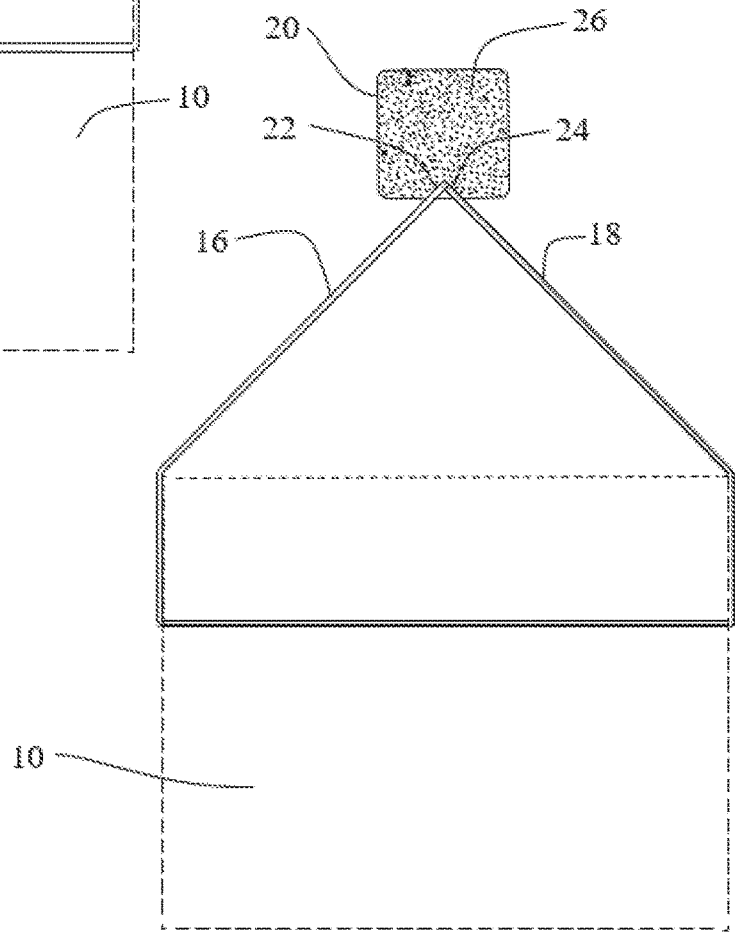

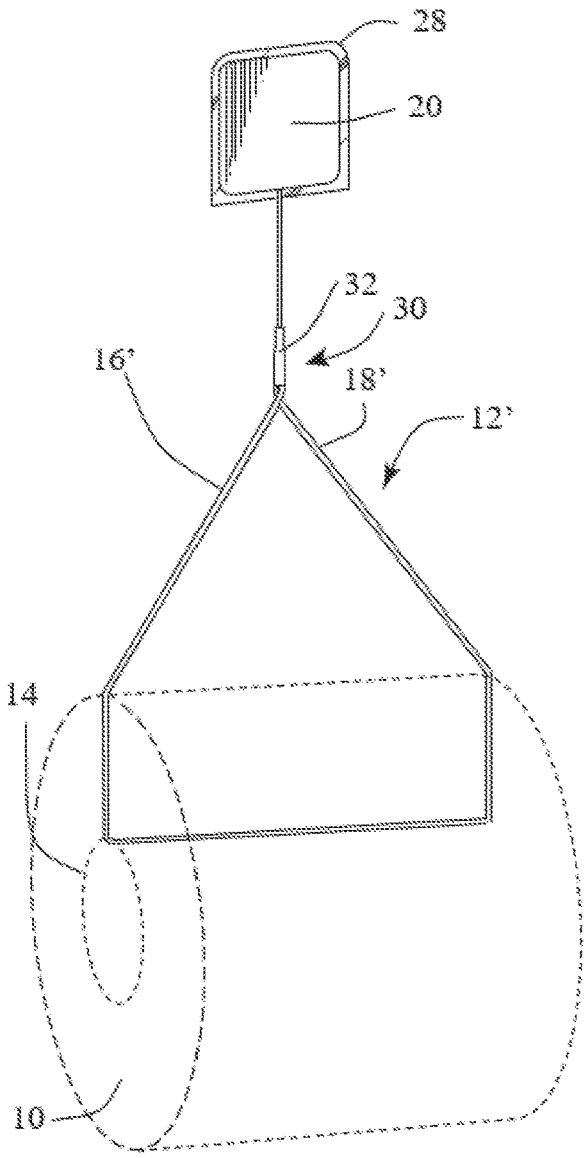
Fig. 8
Fig. 9
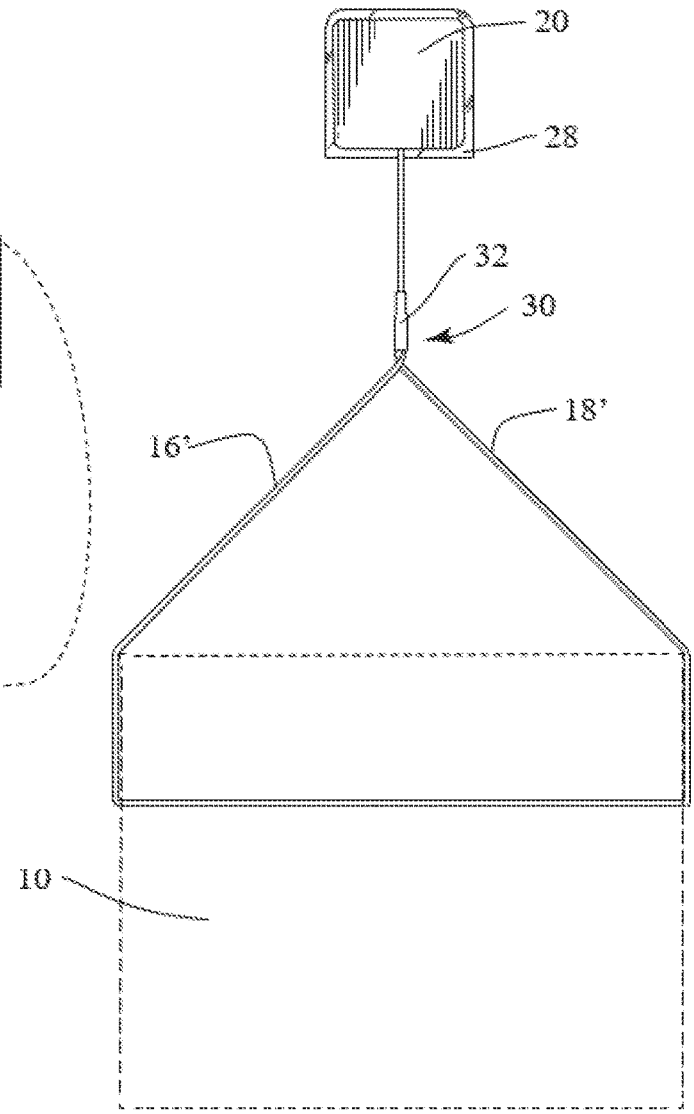

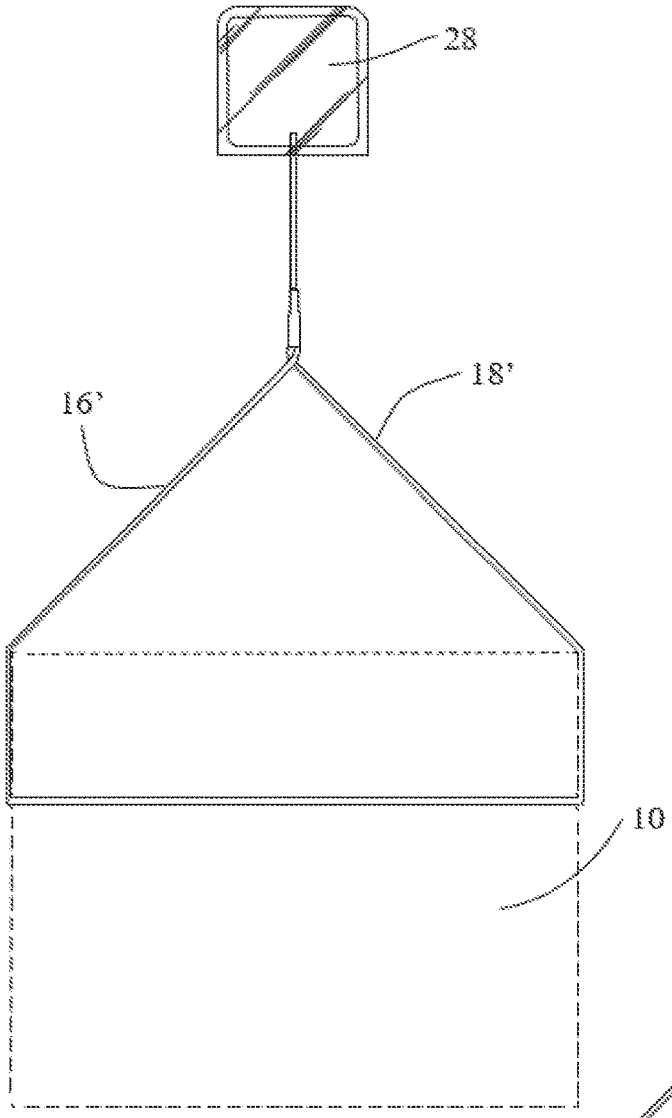
Fig. 10A
Fig. 10B
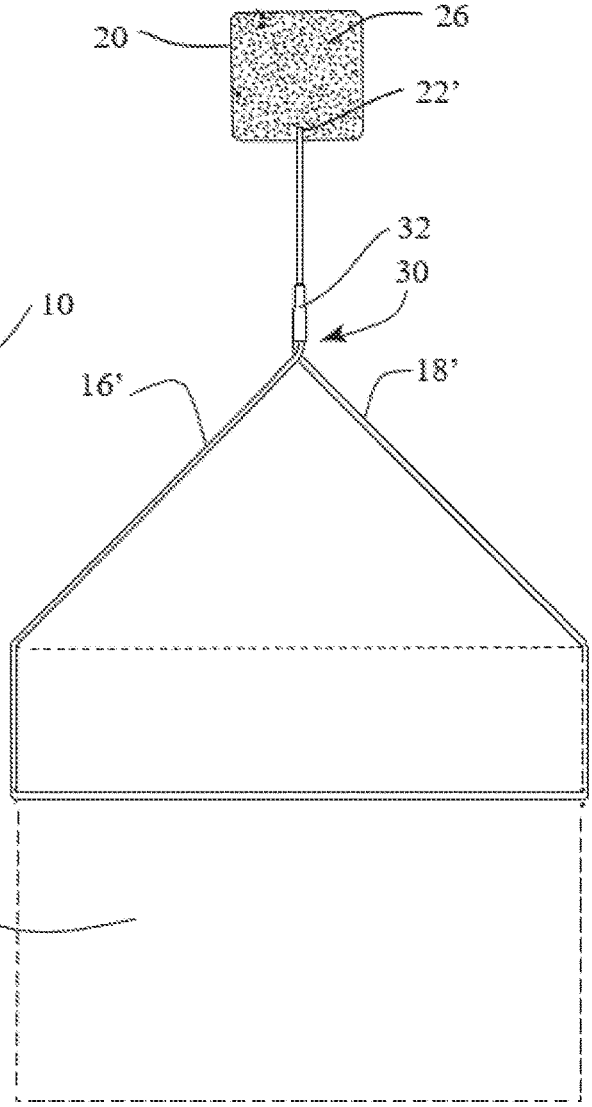

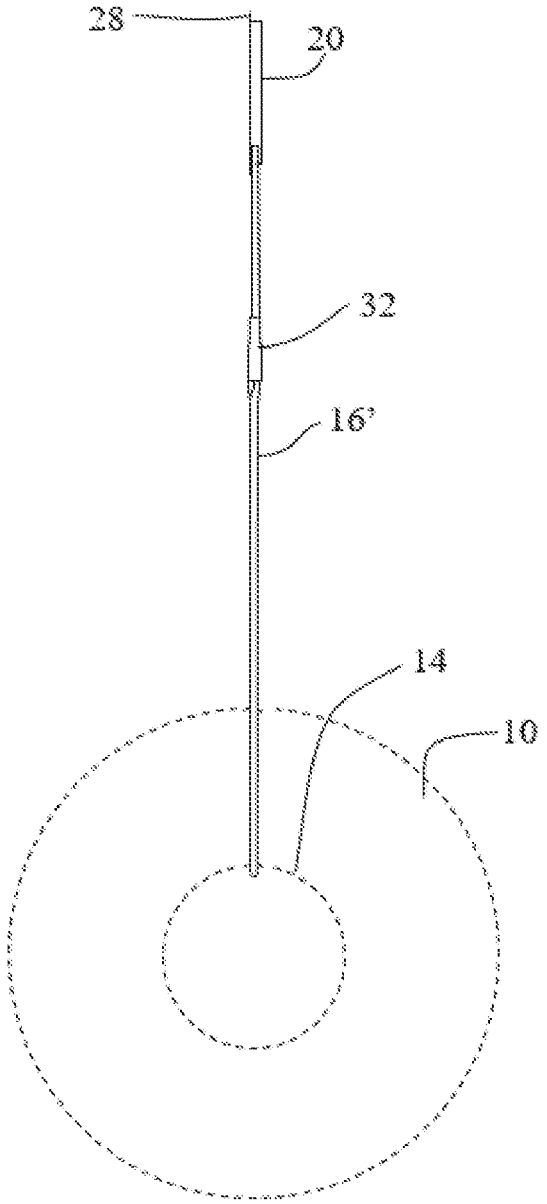
Fig. 11
Fig. 12
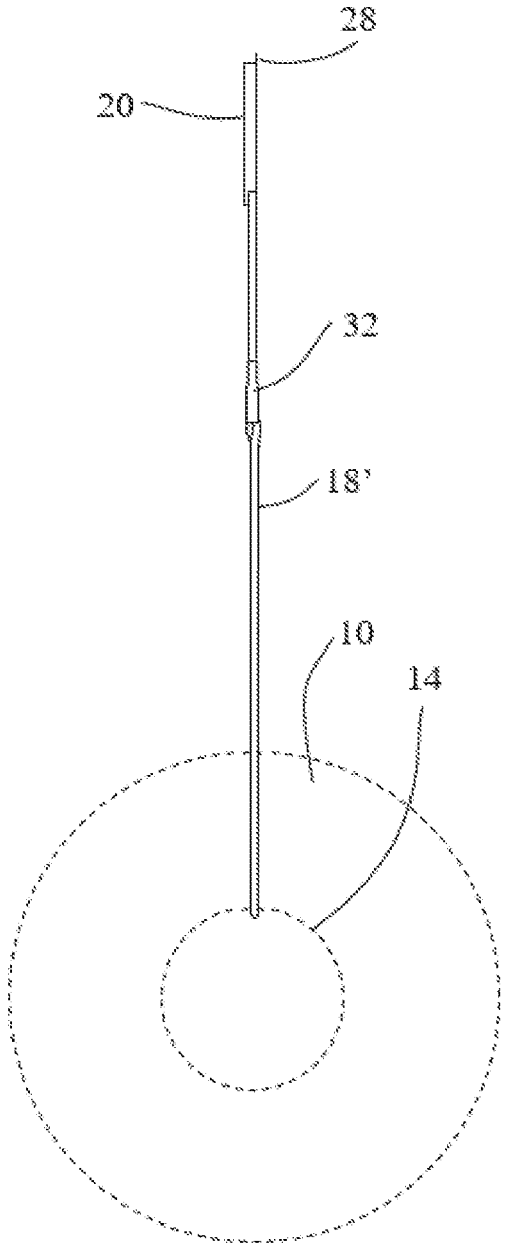

Fig. 22
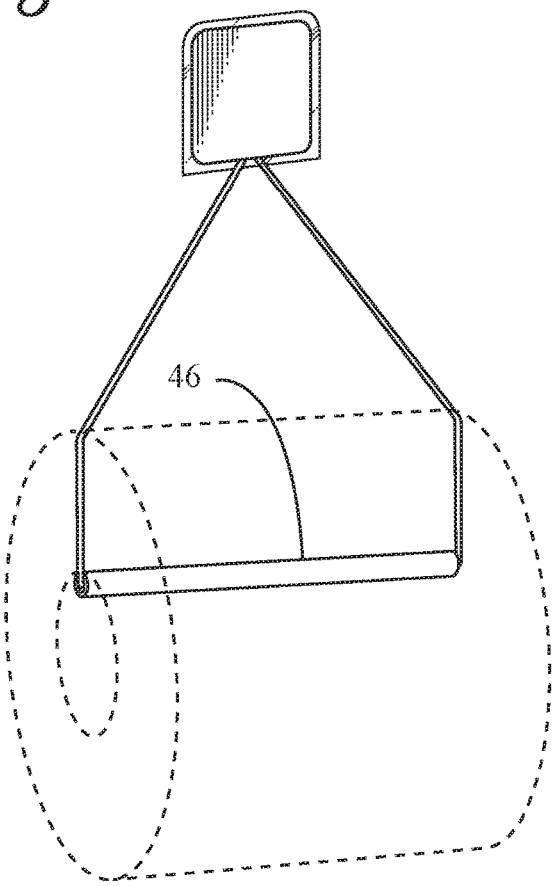
Fig. 23
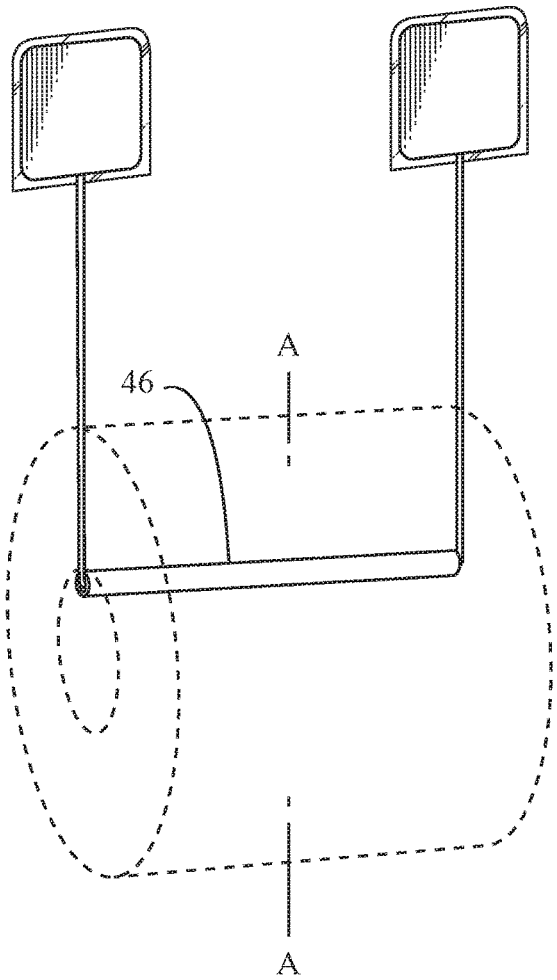
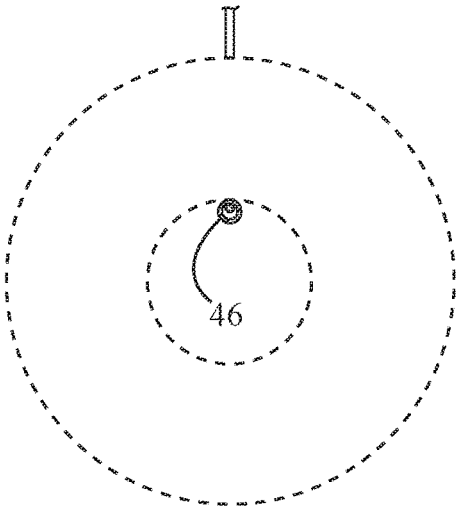
Fig. 24

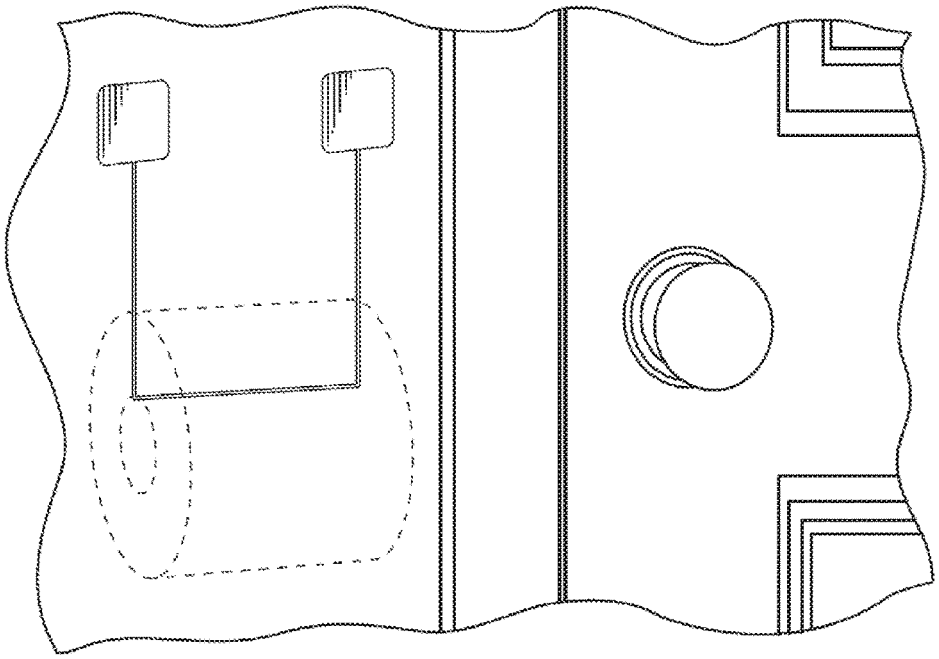
Fig. 25A
Fig. 25B
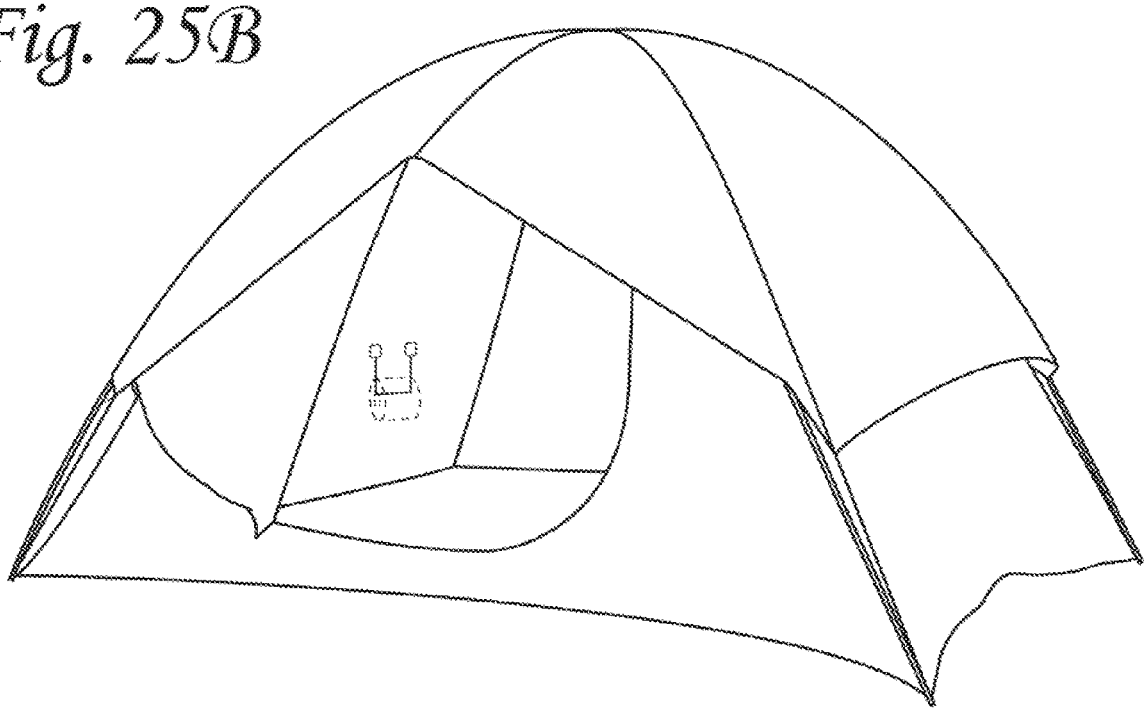

ROLL HOLDER

CROSS-REFERENCE TO RELATED APPLICATIONS

This application claims the benefit of Nonprovisional patent application Ser. No. 14/994,978, filed Jan. 13, 2016.

FIELD OF THE INVENTION

The invention relates to a roll holder such as for toilet paper or a roll of absorbent sheet material.

BACKGROUND OF THE INVENTION

A very wide variety of holders are known to facilitate the dispensing of roll paper such as toilet paper or a kitchen roll of paper or water-absorbent material. These include wall mounted devices and stand-alone devices. Wall mounted devices are connected to a wall and include spring loaded telescopic cores held between mounts that extend from a wall, and U-shaped metal rods that extend from a wall either horizontally or formed as an upright. Some of the holders are mainly functional while others are designer holders providing a bathroom or kitchen highlight for what otherwise would be a pedestrian device. A designer roll holder sold by Vandiss as the Diabolo Toilet Paper Holder (http://shop.gessato.com/diabo-toilet-paper-holder-by-vandiss.html) uses a pulley mounted on a wall. Nautical rope is threaded through the hollow cylindrical core of a roll of toilet paper and is wrapped around the hub of the pulley to suspend the toilet paper. The toilet paper holder derives its mode of operation from the juggling toy that consists of a top in the form of a deep pulley balanced across a string. It is secured against the wall by use of adhesive applied to both the wall and to the back of the pulley, using heat such as from a hair blower followed by curing for 72 hours. A significant purpose of such a pulley holder is ornamental as are many of the various designer paper roll holders.

When a person needing the use of toilet paper or absorbent paper is not in a home having a bathroom or kitchen, for example when camping or when the person is homeless or living in meager or rundown housing, then the only recourse is to carry tissue paper or an unsupported paper roll. The use of a stand-alone device is not practical as it would be burdensome to carry such a device, and wall mounted devices of the prior art such as the afore-described pulley holder are not feasible. There is a need for a paper roll holder that can readily be mounted on the wall of a tent or on a wall that is too thin to support the usual holder, or which cannot be drilled into, or even on a wall under an overpass that often serves as a shelter for homeless people. Such a holder must be simple and inexpensive yet must provide the convenience of a fully functional wall mounted paper roll holder.

In Nonprovisional patent application Ser. No. 14/994,978, filed Jan. 13, 2016 ("the '978 application") by the current inventor, the holder was a patch and wherein two embodiments were provided. In one embodiment, the two legs of cordage can be joined at their ends and at its juncture secured to the patch. In a second embodiment, one end of one leg of the cordage is fixed at a distal point below the patch to the other leg, the end of which is secured to the patch. Fixing can be by knotting or by fusion and can be overlaid within a plastic sleeve.

BRIEF SUMMARY OF THE INVENTION

The present invention provides such a holder also in the form of cordage that is inserted through the hollow cylindrical core of a roll of toilet paper or roll of absorbent sheet material forming two legs and suspended from a wall by a holder. In the present invention, the holder can be either an adhesive patch or a suction cup to which the cordage is fixed. The surface from which the cordage is suspended can be any surface such as a wall, or tent material, or even thin plastic from which trash bags are formed. The surface is such as to be convenient to someone who is camping or someone who is homeless or who needs to be makeshift quarters.

The present invention provides a holder for a roll of toilet paper or a roll of absorbent sheet material, the holder being constructed to have one side mountable directly to a surface. The holder includes two or more, paper, cloth or thin plastic sheet patches, each having an adhesive surface covered by a release sheet on said side, or the holder is a suction cup or one or more suction cups. The roll is supported suspended from the string or rope cord secured to each patch or to the suction cup or one or more suction cups.

As in the '978 application, cord constituting the cordage can be formed of string, cable, braiding such as braided thread, lace, lanyard, or twine. It can be a single cord or be formed of multiple cords. In one embodiment the holder is a patch and the cordage can be secured to the patch by the adhesive of the patch or can be sewn to the patch. The patch is a piece of material of any convenient shape, square, triangular, circular or the like formed of paper, cloth or thin (i.e., less than 0.3 cm thick) plastic sheet. It has adhesive on a side which can be covered by a paper, cloth or thin plastic release sheet which can be opaque or clear and may carry printing on its outer side. Such printing can be a design or text or a combination thereof and can be a logographic for the company manufacturing the holder or a third party to generate advertising revenue.

In another embodiment, the holder is one suction cup or more than one suction cups. In one form of this embodiment ("the suction cup embodiment"), two suction cups support the roll. In a second form of this embodiment, one end of one leg of the cordage is fixed at a distal point below the suction cup to the other leg, the end of which is secured to the suction cup. As in the '978 application, fixing can be by knotting or by fusion and can be overlaid within a plastic sleeve. In a second form of the suction cup embodiment, the two legs of the cordage are secured to the suction cup.

In the suction cup embodiment, securement to the suction cup or suction cups can be by any means, preferably by forming a hole in the neck of each suction cup, threading the cord or cords through the hole and tying a knot at the cord ends or fusing the cord ends so that the ends cannot be withdrawn through the hole.

In another embodiment, useful with each of the foregoing embodiments, is the use of a roller in the form of a tube through which the cordage is inserted and which itself is inserted through the hollow cylindrical core of a roll of toilet paper or roll of absorbent sheet material. The roller serves to facilitate rotation of the paper role.

The holder can be provided independent of the roll it is to support, or it can be provided already inserted through the core of the roll with the ends of the cordage secured.

BRIEF DESCRIPTION OF THE DRAWINGS

For a more complete understanding of the present invention, reference is now made to the following descriptions taken in conjunction with the accompanying drawing, in which the broken lines are for the purpose of illustrating a roll of paper carried by the holder and in which:

FIG. 3A is a rear plan view of the embodiment of FIG. 1, showing a clear plastic release sheet carried on an adhesive layer;

FIG. 3B is a rear plan view of the embodiment of FIG. 3A with the clear plastic release sheet removed exposing the adhesive layer;

FIG. 8 is a front perspective view of a second embodiment of the invention, using a patch as the holder;

FIG. 9 is a front plan view of the embodiment of FIG. 8;

FIG. 10A is a rear plan view of the embodiment of FIG. 8, showing a clear plastic release sheet carried on an adhesive layer;

FIG. 10B is a rear plan view of the embodiment of FIG. 10A with the clear plastic release sheet removed exposing the adhesive layer;

FIG. 11 is a left side view of the embodiment of FIG. 8;

FIG. 12 is a right-side view of the embodiment of FIG. 8;

FIG. 22 is a front perspective view of one version of a seventh embodiment similar to the embodiment depicted in FIG. 1 but in which the cordage is inserted through a roller in the form of a tube and which itself is inserted through the hollow cylindrical core of the paper roll;

FIG. 23 is a front perspective view of a second version of a seventh embodiment similar to the embodiment depicted in FIG. 15 but in which the cordage is inserted through a roller identical to the roller shown in FIG. 22 and which itself is inserted through the hollow cylindrical core of the paper roll;

FIG. 24 is a cross-section of the roller depicted in FIG. 23 taken on line A-A of FIG. 23;

FIG. 25A depicts the holder of FIG. 15 adhered to a wall;

FIG. 25B depicts the holder of FIG. 15 adhered to tent material;

DETAILED DESCRIPTION OF THE INVENTION

Figure 1:
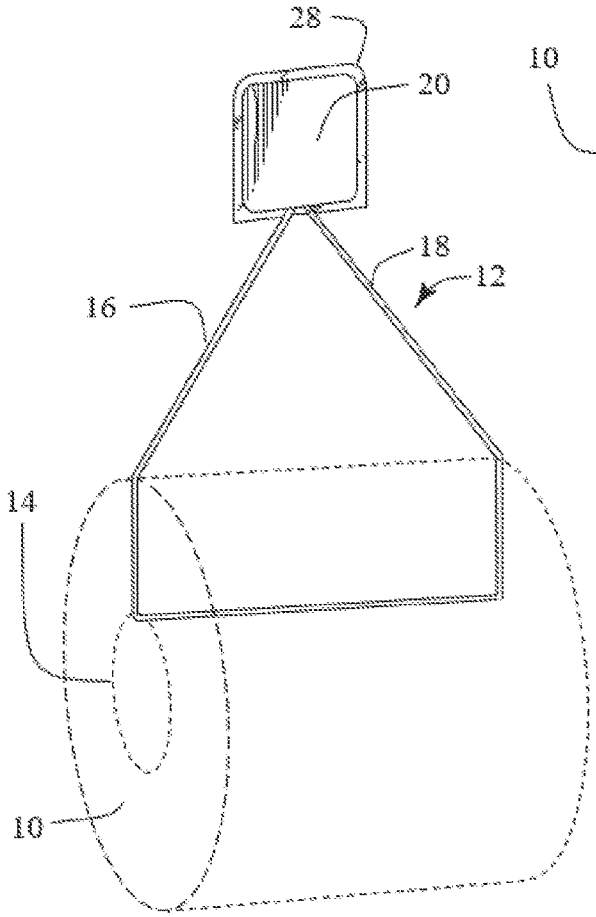
FIG. 1 is a front perspective view of a first embodiment of the invention, using a patch as the holder.

FIGS. 22A-C depict a designer roll holder, and its instruction sheet, sold by Vandiss as the Diabolo Toilet Paper Holder (http://shop.gessato.com/diabolo-toilet-paper-holder-by-vandiss.html) that suspends a roll of toilet paper on a length of nautical rope that is threaded through the hollow cylindrical core of a roll of toilet paper and is wrapped around the hub of a pulley to suspend the toilet paper. The pulley is mounted on a wall using adhesive applied to both the wall and to the back of the pulley. Because of the weight of the pulley added to the weight of the roll, mounting requires using heat such as from a hair blower followed by curing for 72 hours.

FIGS. 1-7 depict a first embodiment of the invention in which a roll of paper, illustrated by a roll of toilet paper 10 is suspended by cordage 12. The cordage 12 is inserted through the hollow cylindrical core 14 of the roll of toilet paper or roll of absorbent sheet material forming two legs 16, 18 but rather than being wound about a pulley or other device that needs to be fixed with hardware to a wall, the present invention utilizes an adhesive patch 20 to which the ends 22, 24 of the cordage 12 are secured, as shown in FIG. 3B and to secure the cordage 12 to a wall or other support.

The patch 20 is a piece of material of any convenient shape, square, triangular, circular or the like formed of paper, cloth or thin (i.e., less than 0.3 cm thick) plastic sheet, having adhesive 26 on a side as shown in FIG. 3B. The adhesive 26 can be covered by a release sheet 28, which can be opaque or clear, and may carry printing on its outer side. Such printing can be a design or text or a combination thereof and can be a logographic for the company manufacturing the holder or a third party to generate advertising revenue. The release sheet 28 can be of clear plastic, as shown, of paper or other material. As shown in FIG. 3B, the ends of the cordage 22, 24 can be fixed to the patch 20 by the adhesive 26. Alternatively, or in addition, the ends 22, 24 of the cordage can be sewn to the patch 20 or, if the cordage 12 and patch 20 are of plastic material, they can be fused together.

Referring to FIG. 8-14, a second embodiment is depicted wherein one end of one leg 16' of the cordage 12' is fixed to the other leg 18' at a distal point 30 below the patch 20, the end 22' of the leg 16' being secured to the patch 20. Fixing can be by knotting or by fusion and can be overlaid within a plastic sleeve 32.

Figure 15:
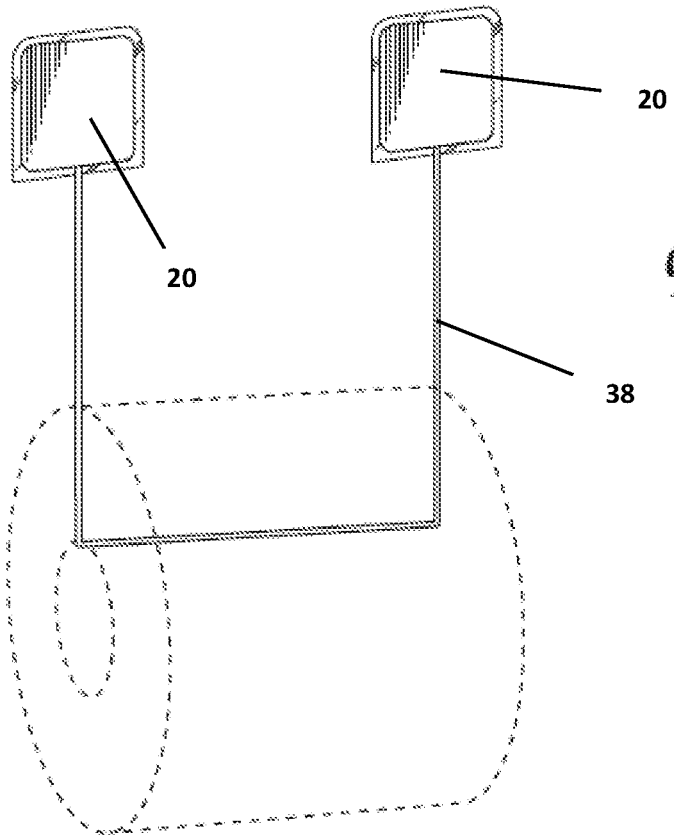
FIG. 15 is a front perspective view of a third embodiment of the invention, using two patches as the holder, each patch being the same as the patch of FIGS. 1-3 and 8-10.

Referring to FIG. 15, a third embodiment is depicted using two patches 20 as the holder fixed to opposite ends of cordage 38. Each patch 20 is the same as the patche referred to in FIGS. 1-3 and 8-10.

Figure 16:
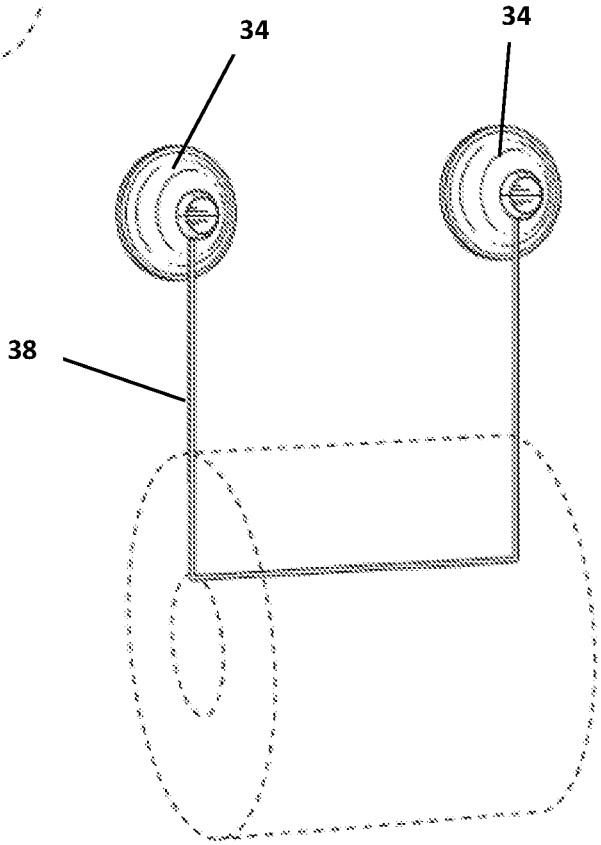
FIG. 16 is a front perspective view of a fourth embodiment of the invention, using two suction cups as the holder.

Referring to FIG. 16, a fourth embodiment is depicted using two suction cups 34 as the holder fixed to opposite ends of the cordage 38 of FIG. 15.

Figure 17:
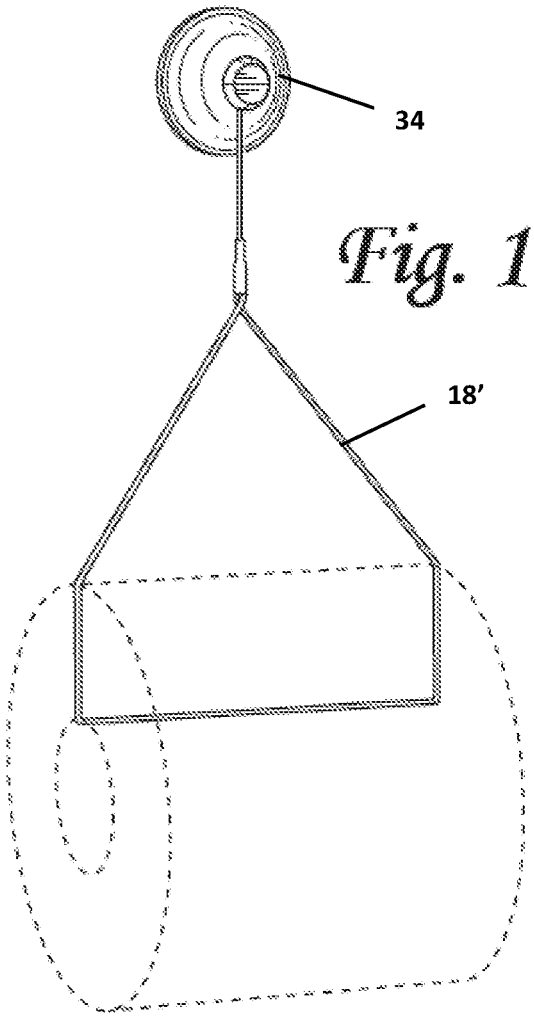
FIG. 17 is a front perspective view of a fifth embodiment of the invention, using a single suction cup as the holder.
Figure 18:
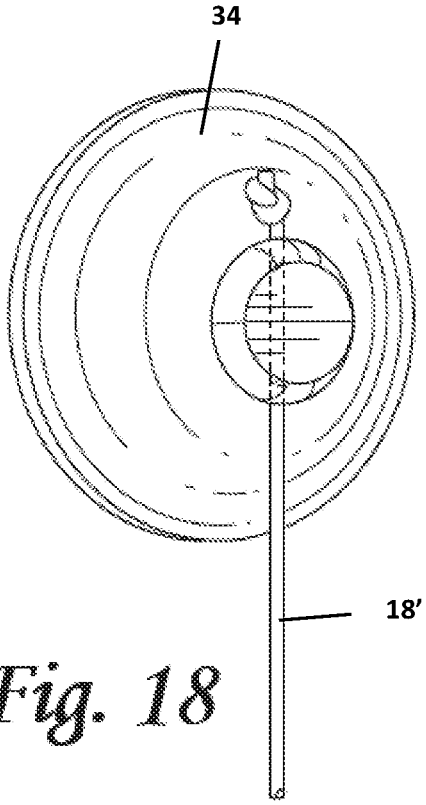
FIG. 18 is a front perspective view of the suction cup and cord used in FIG. 17.
Figure 19:
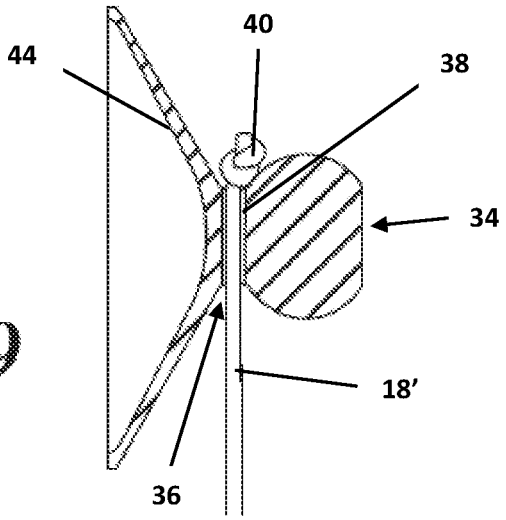
FIG. 19 is a cross-sectional view of the suction cup and cord of FIG. 18.

Referring to FIG. 17, a fifth embodiment is depicted using a single suction cup 34 fixed to the top end of cordage 18' that, other than the holder, is the same as used in the second embodiment shown in FIGS. 8-10;

Referring to FIGS. 18 and 19, depicted is, respectively, a close-up of the suction cup 34 and its cross-section. The cordage 18' is passed through an opening 36 in the neck 38 of the suction cup 34. In FIG. 18 the cordage is shown extending upwardly of the neck opening 36 after it is tied in a knot 40. In FIG. 19, the cordage 18' is pulled down so that the knot 40 is secured against the neck 38 of the suction cup 34.

Figure 2:
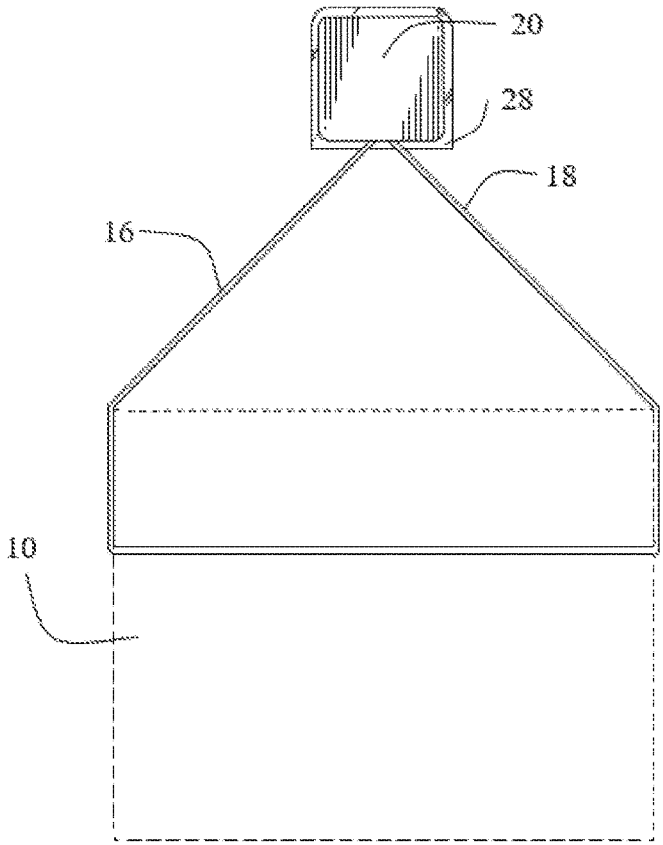
FIG. 2 is a front plan view of the embodiment of FIG. 1.
Figure 4:
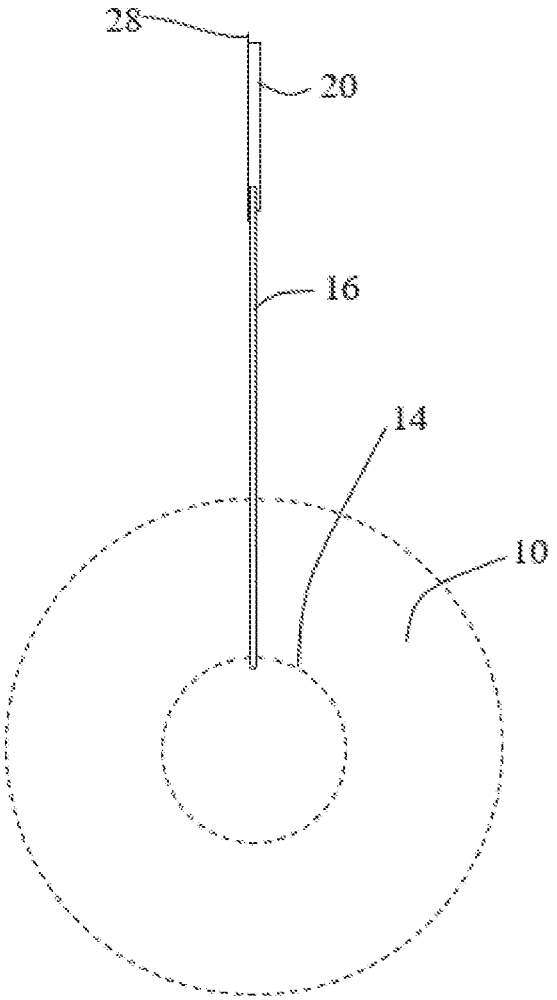
FIG. 4 is a left-side view of the embodiment of FIG. 1.
Figure 5:
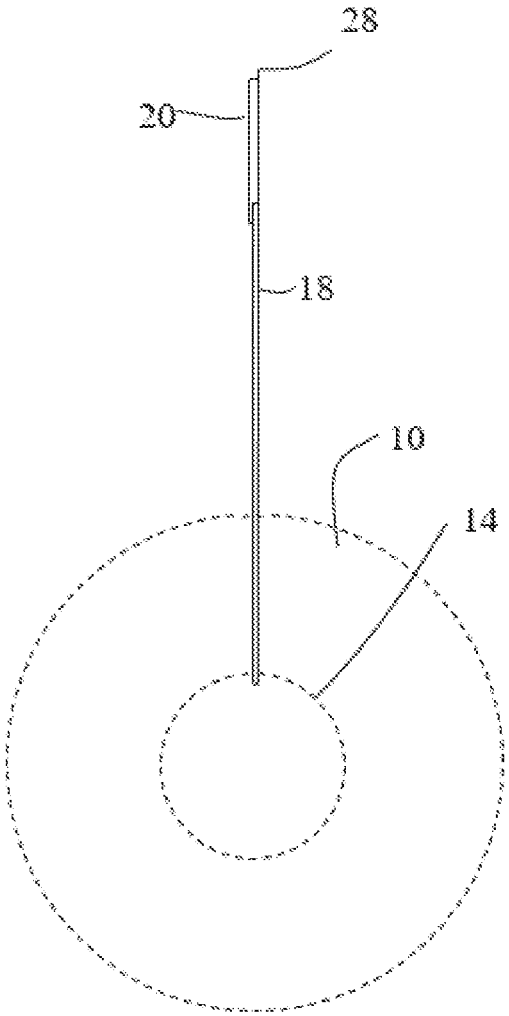
FIG. 5 is a right-side view of the embodiment of FIG. 1.
Figure 6:
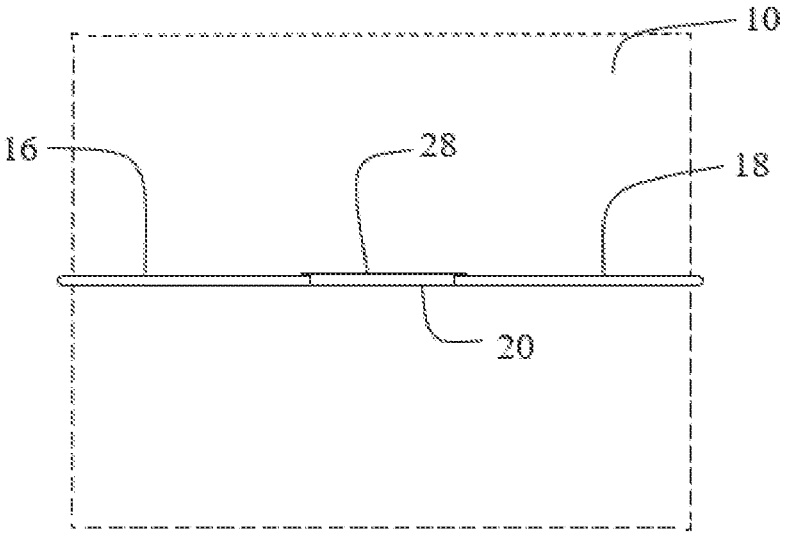
FIG. 6 is a top view of the embodiment of FIG. 1.
Figure 7:
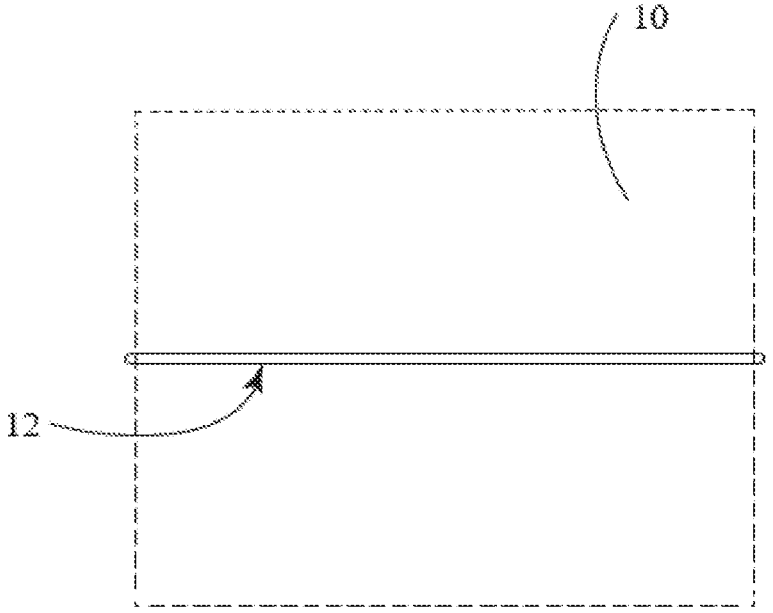
FIG. 7 is a bottom view of the embodiment of FIG. 1.
Figure 13:
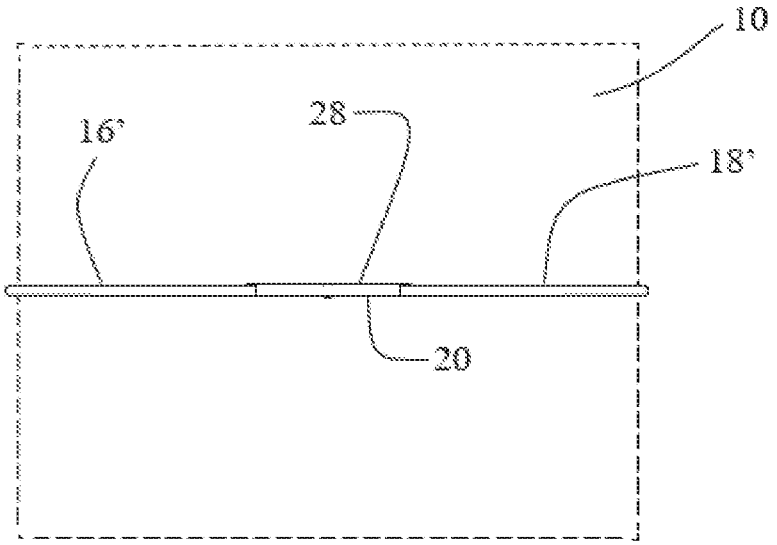
FIG. 13 is a top view of the embodiment of FIG. 8.
Figure 14:
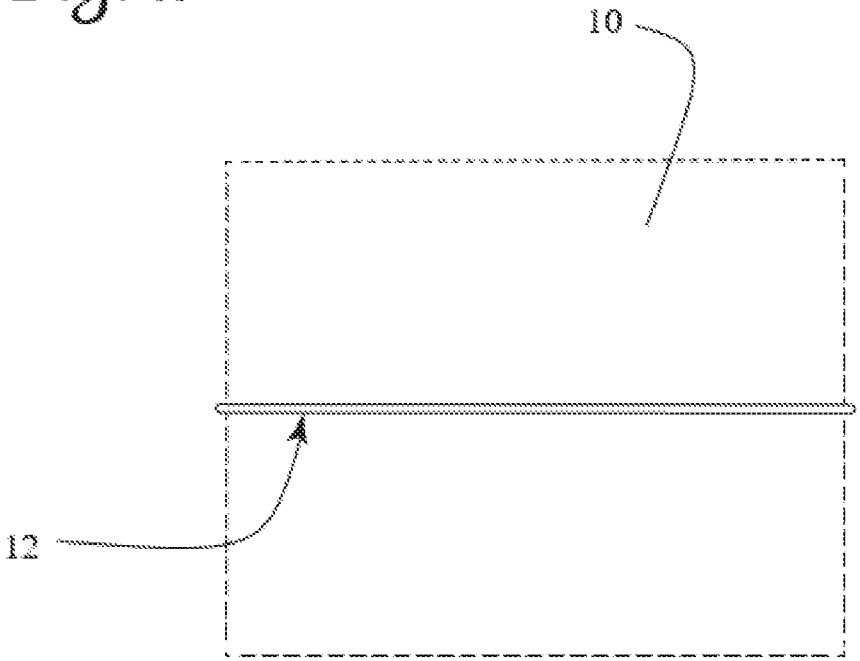
FIG. 14 is a bottom view of the embodiment of FIG. 8.
Figure 20:
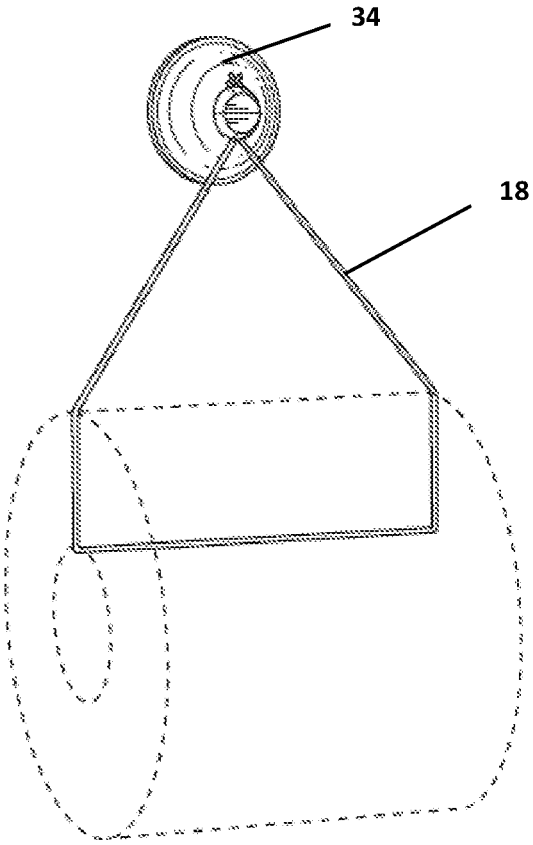
FIG. 20 is a front perspective view of a sixth embodiment of the invention, using a single suction cup as the holder.

Referring to FIG. 20, a sixth embodiment is depicted using a single suction cup 34 fixed to the top end of cordage 18 that, other than the holder, is the same as used in the second embodiment shown in FIG. 1-3.

Figure 21:
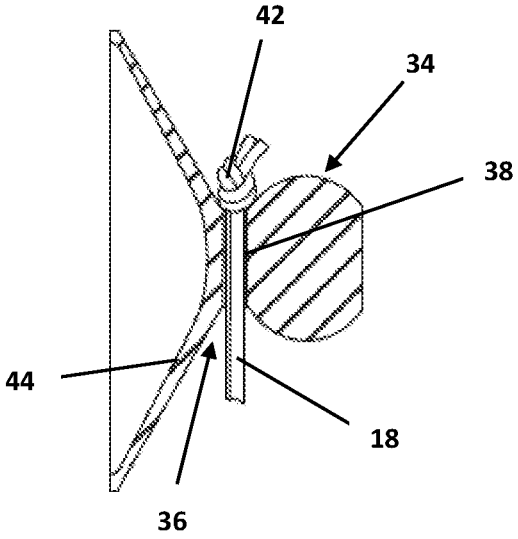
FIG. 21 is a cross-sectional view of the suction cup and cord of FIG. 20.

Referring to FIG. 21, a cross-section of the suction cup 34 is depicted with the two ends of the cordage 18 passed through the opening 36 in the neck 38 of the suction cup 34 and knotted together to form a knot 42 pulled down so that the knot 40 is secured against the neck 38 of the suction cup 34.

The suction cup is a device that uses the negative pressure of air to adhere to a nonporous surface, creating a partial vacuum. The working face of the suction cup has a curved surface 44 and is made of elastic, flexible material, such as rubber, natural or synthetic, or a polymer with sufficient elastic properties.

Figure 25C:
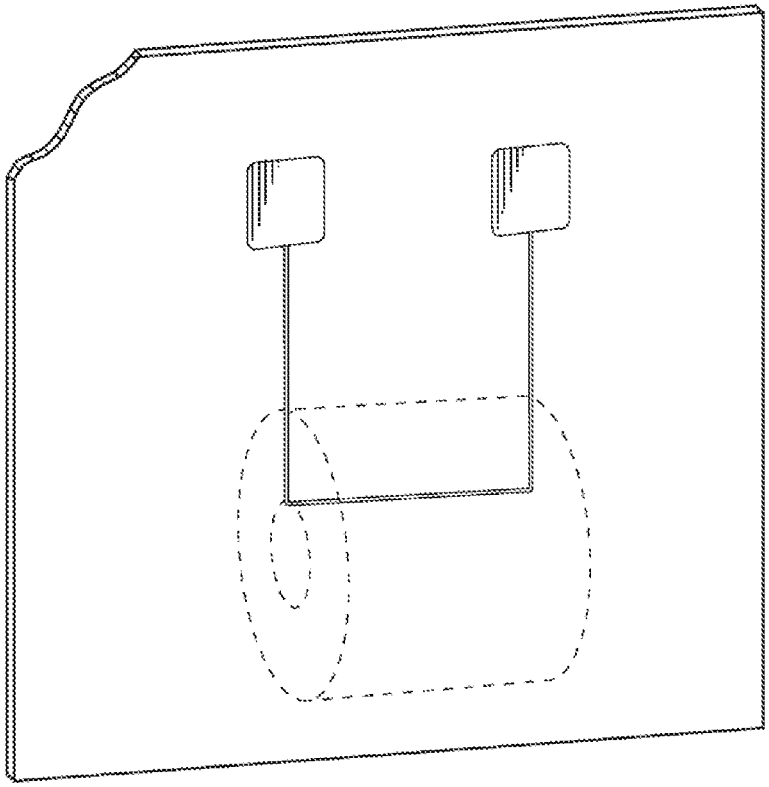
FIG. 25C depicts the holder of FIG. 15 adhered to thin plastic sheeting.
Figure 25D:
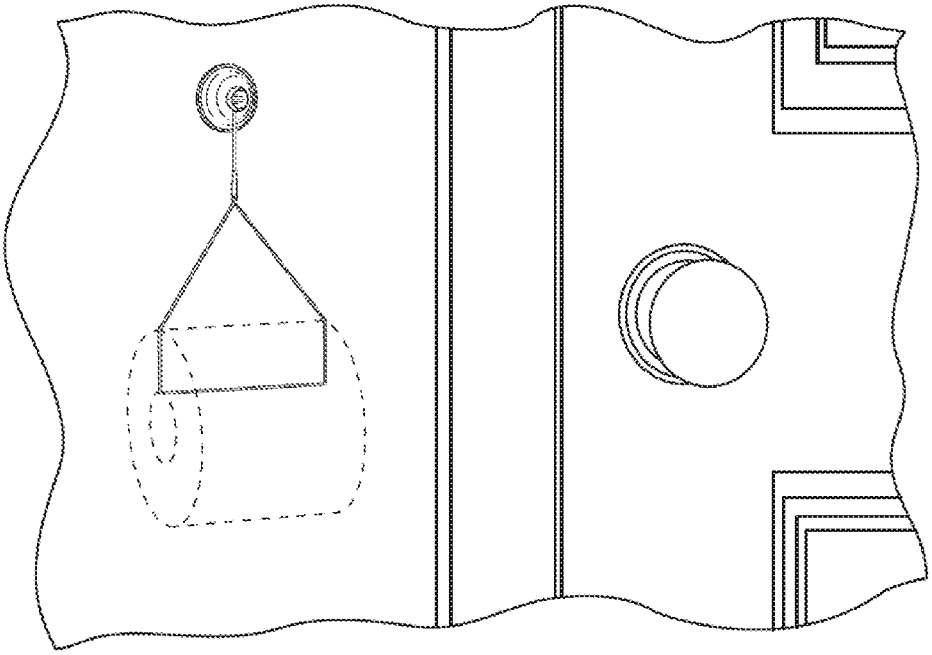
FIG. 25D depicts the holder of FIG. 17 adhered to a wall.
Figure 26A:
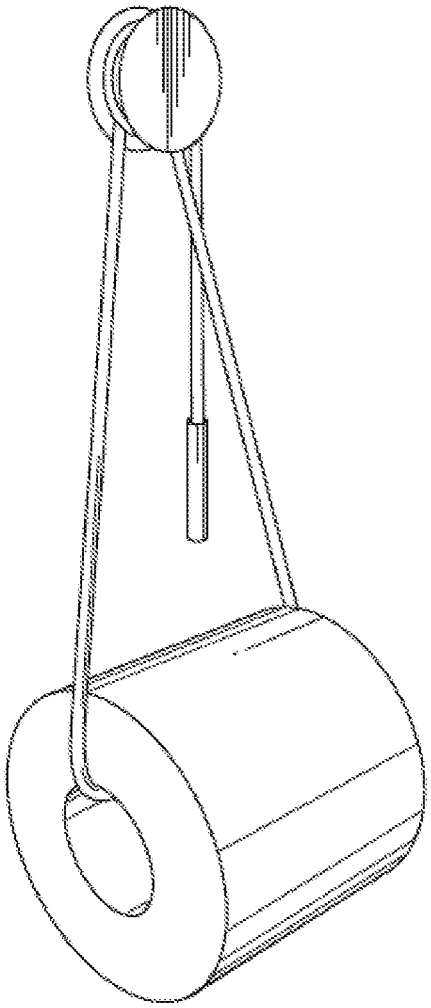
Fig. 26A Prior Art
FIG. 26A depicts a prior art holder designed to mount a pulley onto a wall with a nautical rope threaded through the hollow cylindrical core of a roll of toilet paper and wrapped around the hub of the pulley to suspend the toilet paper.
Figure 26B:
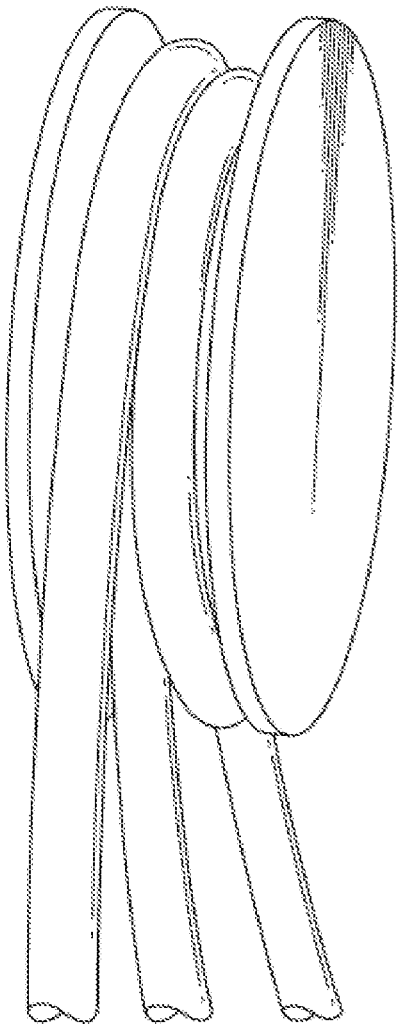
Fig. 26B Prior Art
FIG. 26B depicts a close-up of the pulley region of the holder of FIG. 26A.
Figure 26C:
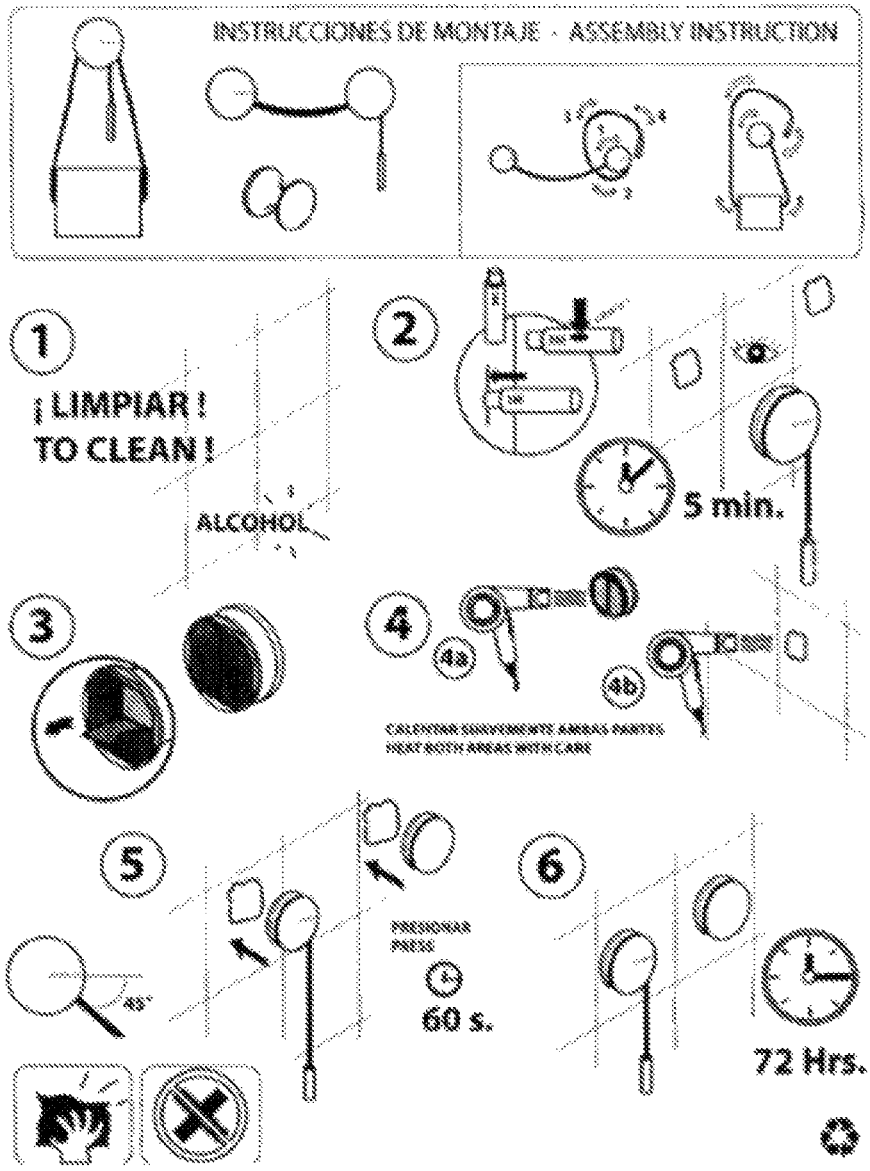
Fig. 26C Prior Art
FIG. 26C is the instruction sheet for the holder of FIG. 26A.

Referring to FIG. 22, there is shown one version of a seventh embodiment that is similar to the embodiment depicted in FIG. 1 but in which the cordage is inserted through a roller 46 in the form of a tube and which itself is inserted through the hollow cylindrical core of the paper roll;

Referring to FIG. 23, there is shown a second version of the seventh embodiment that is similar to the embodiment depicted in FIG. 15 but in which the cordage is inserted through a roller 46 which is identical to the roller 46 shown in FIG. 22 and which itself is inserted through the hollow cylindrical core of the paper roll;

Illustrating use of the holder of this invention adhered respectively to a wall, tent material, and thin plastic sheeting, FIG. 25A depicts the holder of FIG. 15 adhered to a wall, FIG. 25B depicts the holder of FIG. 15 adhered to tent material, FIG. 25C depicts the holder of FIG. 15 adhered to thin plastic sheeting, and FIG. 25D depicts the holder of FIG. 17 adhered to a wall.

FIG. 24 is a cross-section of the roller depicted in FIG. 22 taken on line A-A of FIG. 22;

The cordage 18 or 18' can be formed of string, cable, braiding such as braided thread, lace, lanyard, twine, or cord or any other suitable material.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

The invention claimed is:

1. A holder for a roll of toilet paper or a roll of absorbent sheet material, the holder being constructed to have one side mountable to a wall, tent material, or thin plastic sheeting, the roll having a hollow cylindrical core, the holder comprising two or more separated patches spaced from each other, each patch consisting essentially of paper, cloth or thin plastic sheet, a single adhesive surface on the paper, cloth or thin plastic sheet on said one side, and a single release sheet covering the adhesive surface; and cordage capable of being inserted through the roll core and secured to each patch, each cordage-patch assembly being capable of supporting the roll suspended by the cordage by adhesion of the patch to said surface.

2. The holder of claim 1 wherein the cordage comprises a single cord with two legs extending from the supported roll, each leg being secured at its end to one of the two patches.

3. The holder of claim 1 including a roller in the form of a tube through which the cordage can be inserted, the tube being capable of insertion through the paper roll core.

* * * * *